United States Patent [19]

Davis et al.

[11] 4,195,161

[45] Mar. 25, 1980

[54] POLYESTER FIBER

[75] Inventors: Herbert L. Davis, Convent Station; Michael L. Jaffe, North Plainfield; Michael M. Besso, West Orange, all of N.J.

[73] Assignee: Celanese Corporation, New York, N.Y.

[21] Appl. No.: 888,961

[22] Filed: Mar. 22, 1978

Related U.S. Application Data

[63] Continuation of Ser. No. 400,864, Sep. 26, 1973, abandoned.

[51] Int. Cl.[2] ..... C08G 63/70; C08G 63/18

[52] U.S. Cl. ..... 528/309; 264/176 F; 264/210.5; 264/289.3; 528/502

[58] Field of Search ..... 528/309; 264/176 F, 264/210 F

[56] References Cited

U.S. PATENT DOCUMENTS

| | | | |
|---|---|---|---|
| 2,289,860 | 7/1942 | Babcock | 18/8 |
| 2,880,057 | 3/1959 | Cuculo | 18/54 |
| 2,954,271 | 9/1960 | Cenzato | 264/176 F X |
| 2,995,779 | 4/1961 | Winter | 264/176 F X |
| 3,199,281 | 8/1965 | Maerov et al. | 57/140 |
| 3,216,187 | 11/1965 | Chantry et al. | 57/140 |
| 3,361,859 | 1/1968 | Cenzato | 264/176 F |
| 3,448,573 | 6/1969 | Glen et al. | 264/210 F X |
| 3,511,905 | 5/1970 | Martin | 264/210 F |
| 3,539,680 | 11/1970 | Fukushima et al. | 264/290 T |
| 3,549,597 | 12/1970 | Kitson et al. | 264/176 F X |
| 3,564,835 | 2/1971 | Keefe et al. | 264/290 T |
| 3,715,421 | 2/1973 | Martin et al. | 264/210 F X |
| 3,758,658 | 9/1973 | Riggert | 264/176 F |
| 3,946,100 | 3/1976 | Davis et al. | 264/210 F |

FOREIGN PATENT DOCUMENTS

| | | |
|---|---|---|
| 2117659 | 10/1972 | Fed. Rep. of Germany . |
| 7204536 | 10/1972 | Netherlands . |
| 530479 | 12/1972 | Switzerland . |

*Primary Examiner*—Walter G. Danison
*Attorney, Agent, or Firm*—Kenneth A. Genoni

[57] ABSTRACT

An improved polyester filament (i.e., a principally polyethylene terephthalate filament) suitable for use in commercial applications is provided having a unique internal structure. The filament possesses an interconnected highly oriented crystalline microstructure coextensive with its length coexisting with an interdispersed substantially disoriented non-crystalline phase. The filament microstructure imparts inter alia a propensity for the filament to undergo a low degree of shrinkage under a high degree of force at an elevated temperature as evidenced by a modulus ratio (as defined) of at least 0.1. The filament exhibits a relatively high initial modulus, coupled with a relatively high crystalline orientation function, and a relatively low amorphous orientation function.

25 Claims, 1 Drawing Figure

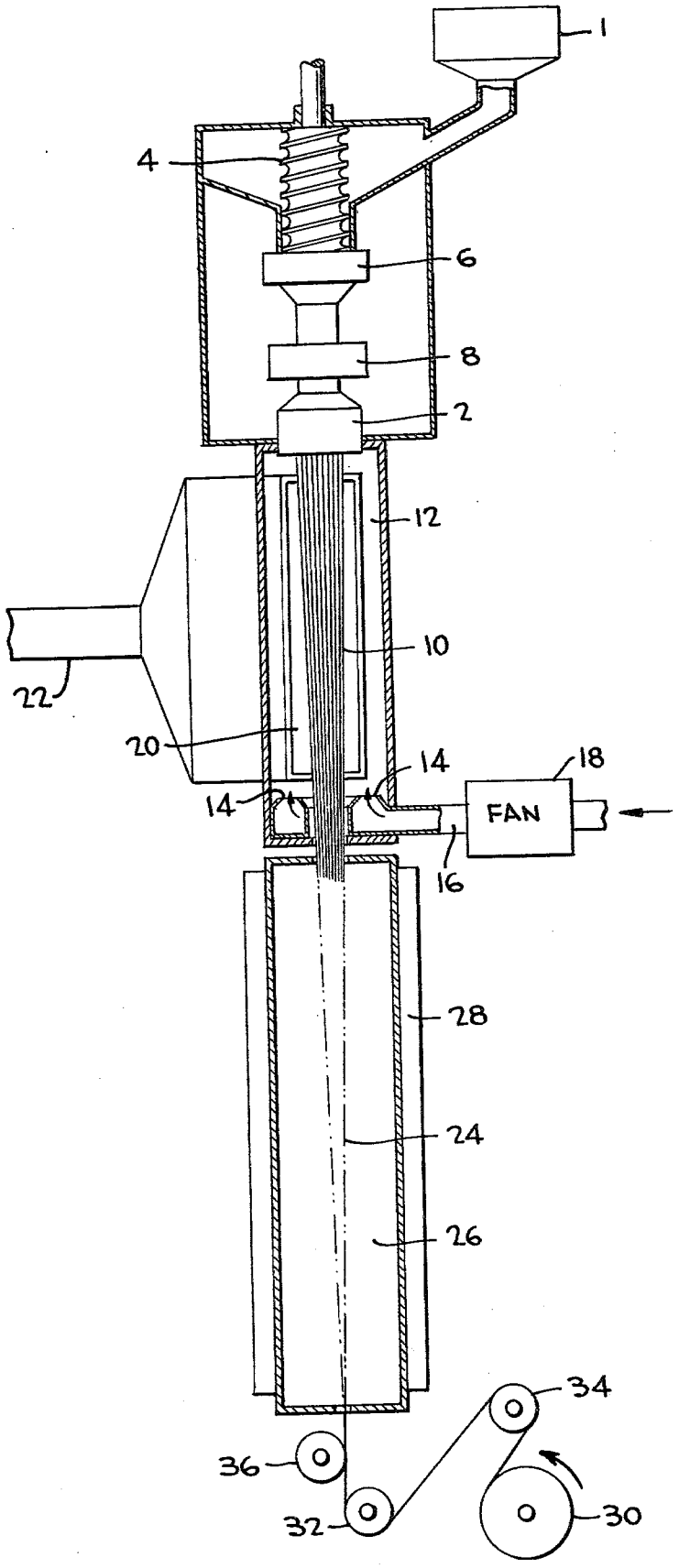
1
4
6
8
2
12
10
22
20
14
18
14
FAN
16
28
24
26
34
36
32
30

POLYESTER FIBER

This is a continuation of application Ser. No. 400,864 filed Sept. 26, 1973, now abandoned.

BACKGROUND OF THE INVENTION

Polyester fibers have been produced in the past under a variety of melt spinning conditions. Both high stress and low stress spinning processes have been employed. Under high stress conditions the as-spun filamentary material is withdrawn from the spinneret under conditions whereby substantial orientation is imparted to the same soon after it is extruded and prior to its complete solidification. See, for instance, U.S. Pat. Nos. 2,604,667 and 2,604,689. Such high stress conditions of the prior art commonly yield a non-uniform filamentary material having an internal structure wherein substantial radial non-homogeneity exists across the fiber diameter leading to self-crimping characteristics upon heating, or less than desired tensile properties.

Polyester spinning processes have also been proposed wherein the cooling of the extruded filamentary material has been retarded (i.e., prolonged) prior to complete solidification so as to alter the properties thereof. See, for instance, U.S. Pat. Nos. 2,323,383; 3,053,611, and 3,361,859.

Heretofore, polyester fibers following extrusion and solidification commonly have been drawn while at an elevated temperature to further enhance their tensile properties. Such drawing may be conducted in an in-line fashion following fiber formation or after the as-spun fiber is unwound from an intermediate collection device. Such drawing is commonly conducted upon contact with an appropriate heating device, heated gaseous atmosphere, or heated liquid medium. Also, it has been known that previously drawn polyester fibers may be heat treated with or without allowed shrinkage (i.e., post-annealed) in order to modify their physical properties.

As-spun polyester filamentary material consisting principally of polyethylene terephthalate, because of its extremely slow crystallization rate at room temperature, forms a stable fiber package unlike an as-spun polyamide filamentary material. As-spun polyamide filamentary materials have a marked tendency to rapidly crystallize at room temperature with an accompanying growth in fiber length thereby rendering wound fiber packages of the same highly unstable and difficult to handle. See, for instance, U.S. Pat. No. 3,291,880 which discloses a process for treating an as-spun polyamide yarn with steam so as to render it capable of forming a stable fiber package. A comparable treatment of an as-spun polyester filamentary material has been completely omitted, since the need for such intermediate processing is absent. Also a polyamide filamentary material commonly is taken up following melt extrusion and solidification at a lower stress for a given take-up speed than a polyester filamentary material formed using the same equipment because of the varying extensional viscosities of the polymeric materials.

While the prior art has been capable of producing polyester filaments suitable for use in commercial applications, no polyester filament is known to have been heretofore produced having the internal structure and resulting property balance of the polyester filament which forms the subject matter of the present invention.

It is an object of the present invention to provide an improved polyester filament possessing a unique microstructure.

It is an object of the present invention to provide an improved polyester filament suitable for use in commercial applications.

It is another object of the present invention to provide an improved polyester filament exhibiting a balance of properties heretofore never achieved in prior polyester filaments.

These and other objects, as well as the scope, nature and utilization of the invention, will be apparent to those skilled in the art from the following description and appended claims.

SUMMARY OF THE INVENTION

It has been found that an improved polyester filament suitable for use in commercial applications comprises at least 85 mol percent of polyethylene terephthalate, has an interconnected highly oriented crystalline microstructure coextensive with the length of the filament coexisting with an interdispersed substantially disoriented non-crystalline phase, and exhibits a propensity to undergo a low degree of shrinkage with a high degree of force at an elevated temperature as evidenced by a modulus ratio of at least 0.1.

It has been found that an improved polyester filament suitable for use in commercial applications comprises at least 85 mol percent of polyethylene terephthalate, has an interconnected highly oriented crystalline microstructure coextensive with the length of the filament coexisting with an interdispersed substantially disoriented non-crystalline phase, a mean initial modulus when present in a multifilament yarn at 25° C. of at least 55 grams per denier, a birefringence of about 0.10 to 0.14, a crystalline orientation function of at least 0.88, and an amorphous orientation function of not more than 0.35.

DESCRIPTION OF THE DRAWING

The drawing is a schematic presentation of an apparatus arrangement capable of forming the improved polyester filament of the present invention.

DESCRIPTION OF PREFERRED EMBODIMENTS

The polyester filament of the present invention principally is composed of polyethylene terephthalate, and contains at least 85 mol percent of polyethylene terephthalate, and preferably at least 90 mol percent polyethylene terephthalate. In a particularly preferred embodiment of the process the polyester filament is substantially all polyethylene terephthalate. Alternatively, during the preparation of the polyester minor amounts of one or more ester-forming ingredients other than ethylene glycol and terephthalic acid or its derivatives may be copolymerized. For instance, the melt-spinnable polyester may contain 85 to 100 mol percent (preferably 90 to 100 mol percent) polyethylene terephthalate structural units and 0 to 15 mol percent (preferably 0 to 10 mol percent) copolymerized ester units other than polyethylene terephthalate. Illustrative examples of other ester-forming ingredients which may be copolymerized with the polyethylene terephthalate units include glycols such as diethylene glycol, tetramethylene glycol, hexamethylene glycol, etc., and dicarboxylic acids such as hexahydroterephthalic acid, bibenzoic acid, adipic acid, sebacic acid, azelaic acid, etc.

The improved polyester filaments of the present invention are suitable for use in textile or other commercial applications, may be woven or knitted to form fabrics, and commonly possess a denier per filament of about 1 to 15, e.g., about 1 to 10 or 1.5 to 5. The polyester filaments conveniently may be provided in the form of continuous multifilament yarns. For instance, continuous multifilament yarns of about 6 to 200 filaments may be provided, e.g., yarns of about 20 to 36 continuous filaments.

The improved polyester filaments of the present invention possess a unique internal structure. A polyester filament in accordance with the present invention possesses an interconnected highly oriented crystalline microstructure coextensive with its length. The high degree of orientation of the crystalline regions of the filaments may be determined by standard wide angle x-ray diffraction analysis. The region of the fiber between the interconnected highly oriented crystalline microstructure is composed of non-crystalline (amorphous) polymeric chains or chain segments in a substantially relaxed low orientation form as is evident by the low shrinkage and the low amorphous orientation function exhibited by this structure at elevated temperature. The relationship between low shrinkage and low amorphous orientation is documented in the open literature. See, for example, the article by Robert J. Samuels in *J. Polymer Science,* A2, 10,781 (1972). The interconnections are generally non-crystalline in nature and serve the function of further binding the polymeric highly crystalline regions into a unitary microstructure. The presence of interconnections may be deduced from the level of the mechanical and thermomechanical properties exhibited by the filaments.

The internal structure possessed by the improved polyester filaments of the present invention further manifests itself in a balance of properties heretofore unattained in a polyester filament. Discussed in detail below are various properties exhibited by these filaments. The tensile and thermomechanical properties reported taken individually have heretofore been exhibited by polyester filaments of the prior art. However, no polyester filament has been provided in the past having the highly satisfactory tensile properties reported in combination with the thermomechanical properties reported. More specifically, the microstructure of the polyester filaments of the present invention renders the same capable of undergoing only a limited degree of shrinkage at an elevated temperature which occurs under a high degree of force. This property balance of the filament is summarized in its "modulus ratio" as defined hereafter. The property balance exhibited renders the polyester filaments of the present invention particularly suited for use in general textile or other commercial applications.

As indicated below, many of the tests whereby the polyester filaments are characterized may be conveniently conducted by the testing of continuous multifilament yarns consisting of the polyester filaments. The number of filaments present in the yarn undergoing testing may be varied, and may conveniently range from about 10 to 30, e.g., 20. The filaments present in the yarn during testing are untwisted. It will be appreciated by those skilled in the art that particularly in the area of tenacity and initial modulus measurement that slightly higher mean values are rendered if single filament testing is substituted for multifilament yarn testing.

The polyester filaments of the present invention commonly exhibit when present in a multifilament yarn at room temperature, i.e., 25° C., the mean tensile properties indicated below:

| | Preferred Embodiment | Particularly Preferred Embodiment |
|---|---|---|
| Tenacity | at least 3.25 grams per denier | at least 3.75 grams per denier |
| Initial Modulos | at least 55 grams per denier | at least 75 grams per denier |
| Elongation | less than 75 percent | less than 50 percent |

The tensile properties may be determined through the utilization of an Instron tensile tester (Model TM) using a 3⅓ inch gauge length and a strain rate of 60 percent per minute in accordance with ASTM D2256. The yarn prior to testing is conditioned for 48 hours at 70° F. and 65 percent relative humidity in accordance with ASTM D1776. It will be noted that the tenacity and initial modulus values are comparable to those encountered in commercial polyester filaments of the prior art.

The polyester filaments of the present invention exhibit highly desirable thermomechanical properties at elevated temperatures which result in improved dimensional stability. When present in a multifilament yarn in air, the filaments shrink less than 5 percent at 100° C. (preferably less than 3.8 percent), and less than 8 percent at 175° C. (preferably less than 7.6 percent). The above shrinkage values may be determined through the utilization of a duPont Thermomechanical Analyzer (Model 941) operated under zero applied load and at 10° C./min. heating rate with the gauge length held constant at 0.5 inch.

Additionally the polyester filaments of the present invention exhibit an unusually high internal tension or shrinkage force when present at an elevated temperature. When present in a multifilament yarn at 100° C., the filaments exhibit a mean internal tension of about 0.3 to 0.5 grams per denier. Commonly a maximum internal tension of about 0.4 grams per denier is observed. The above internal tension values may be determined through the utilization of an Instron tensile tester fitted with a programmed fast response oven. A yarn sample is clamped into the jaws of the tester and heated in air at 10° C./min. while being held at a constant length. While the test is not gauge length sensitive, a gauge length of about 6 inches conveniently may be selected. The force generated by the yarn while being heated is monitored as a function of the yarn temperature on a suitable recording device. The force at a given temperature divided by the yarn denier is defined as the internal tension at that temperature. The internal tension is a measurement of the stress introduced into the yarn during processing and as such reflects the stability of the molecular chain conformations present in that structure, especially of the interconnections and other species present in the non-crystalline regions.

The thermomechanical properties of the polyester filaments of the present invention may be summarized through the computation of the "shrinkage modulus" parameter which is defined as the mean internal tension at a given temperature when present in a multifilament yarn divided by the mean percent shrinkage at that temperature when present in a multifilament yarn times 100. The polyester filaments of the present invention when present in a multifilament yarn commonly exhibit a shrinkage modulus of at least about 9.0 grams per denier at 100° C., and a shrinkage modulus of at least about 3.5 grams per denier at 175° C. Such values are higher than those encountered in the prior art. The shrinkage modulus as here defined reflects the tautness of those molecular chains serving as interconnections between crystalline regions as compared to the overall orientation of the non-crystalline molecular chains. A high shrinkage modulus implies taut, efficient interconnections co-existing with a generally relaxed non-crystalline phase.

The unique balance of tensile properties and thermomechanical properties of the filaments of the present invention is evidenced through the computation of the "modulus ratio" for the filaments which is defined as the shrinkage modulus of the filaments at 100° C. when present in a multifilament yarn divided by the mean initial modulus of the filaments when present in a multifilament yarn at room temperature (i.e., 25° C.). The polyester filaments of the present invention exhibit a modulus ratio of at least 0.1, e.g., about 0.1 to 0.2. Polyester filaments of the prior art exhibit a substantially lower modulus ratio. The modulus ratio reflects the relative load-bearing efficiency of the fiber structure at elevated temperatures as compared to room temperature.

The polyester filaments of the present invention also commonly exhibit a mean birefringence of about 0.10 to 0.14 (e.g., about 0.11 to 0.14), which is a range not commonly exhibited by commercial polyester fibers. The birefringence of the filaments can be determined by using a Berek compensator mounted in a polarizing light microscope, and expresses the difference in the refractive index parallel and perpendicular to the fiber axis.

The improved polyester filament of the present invention may also be characterized without specific reference to its thermomechanical properties. Such filaments exhibit a relatively high initial modulus, coupled with a relatively high crystalline orientation function, and a relatively low amorphous orientation function. For instance, the polyester filament may exhibit a mean initial modulus when present in a multifilament yarn at 25° C. of at least 55 grams per denier, a birefringence of about 0.10 to 0.14, a crystalline orientation function ($f_c$) of at least 0.88 (e.g., about 0.88 to 0.95), and an amorphous orientation function ($f_a$) of not more than 0.35 (e.g., about 0.15 to 0.35).

As will be apparent to those skilled in the art, the birefringence of the filament is a function of the filament crystalline portion and the filament amorphous portion. See, for instance, the article by Robert J. Samuels in *J. Polymer Science*, A2, 10, 781 (1972). The birefringence may be expressed by the equation:

$$\Delta n = Xf_c\Delta n_c + (1-X)f_a\Delta n_a + \Delta n_f \quad (1)$$

where $\Delta n$ = birefringence
X = fraction crystalline
$f_c$ = crystalline orientation parameter
$\Delta n_c$ = intrinsic birefringence of crystal (0.220 for polyethylene terephthalate)
$f_a$ = amorphous orientation parameter
$\Delta n_a$ = intrinsic birefringence of amorphous (0.275 for polyethylene terephthalate
$\Delta n_f$ = forms birefringence (values small enough to be neglected in this system)

The fraction crystalline, X, may be determined by conventional density measurements. The crystalline orientation parameter, $f_c$, may be calculated from the average orientation angle, $\theta$, as determined by wide angle x-ray diffraction. Photographs of the diffraction pattern may be analyzed for the average angular breadth of the (010) and (100) diffraction arcs to obtain the average orientation angle, $\theta$. The crystalline orientation parameter, $f_c$, may be calculated from the following equation:

$$f_c = \tfrac{1}{4}(3\cos^2\theta - 1) \quad (2)$$

Once $\Delta n$, X, and $f_c$ are known, $f_a$ may be calculated from equation (1). $\Delta n_c$ and $\Delta n_a$ are intrinsic properties of a given chemical structure and will change somewhat as the chemical constitution of the molecule is altered, i.e., by copolymerization, etc.

In our commonly assigned United States Serial No. 400,863, filed Sept. 26, 1973 (now U.S. Pat. No. 3,946,100), and entitled "Improved Process for the Expeditious Formation and Structural Modification of Polymeric Fibers and Films" is claimed a process capable of yielding the improved polyester filaments of the present invention.

The melt-spinnable polyester utilized in the process preferably exhibits an intrinsic viscosity, i.e., an I.V., of about 0.45 to 1.0, and an I.V. of about 0.6 to 0.95 in a particularly preferred embodiment of the process. The I.V. of the melt-spinnable polyester may be conveniently determined by the equation $$\lim_{c \to 0} \frac{\ln \eta r}{c},$$

where $\eta r$ is the "relative viscosity" obtained by dividing the viscosity of a dilute solution of the polymer by the viscosity of the solvent employed (measured at the same temperature), and c is the polymer concentration in the solution expressed in grams/100 ml. The fiber-forming polyester additionally commonly exhibits a glass transition temperature of about 75° to 80° C., and a melting point of about 250° to 265° C., e.g., about 260° C.

The spinneret selected for use in the process may contain one or preferably a plurality of extrusion orifices. For instance, a standard conical spinneret containing 1 to 200 holes (e.g., 6 to 200 holes), such as commonly used in the melt spinning of polyethylene terephthalate, having a diameter of about 10 to 60 mils (e.g., 10 to 40 mils) may be utilized in the process. Yarns of about 20 to 36 continuous filaments are commonly formed. The melt-spinnable polyester is supplied to the spinneret at a temperature above its melting point.

The molten polyester is preferably at a temperature of about 270° to 310° C., and most preferably at a temperature of about 285° to 305° C. (e.g., 300° C.) when extruded through the spinneret.

Subsequent to extrusion through the spinneret the resulting polyester material is passed in the direction of its length through a solidification zone provided with a gaseous atmosphere at a temperature below the glass transition temperature thereof, e.g., below 80° C., wherein the molten filamentary material is transformed to a solid filamentary material. Within the solidification zone the molten material passes from the melt to a semisolid consistency, and from the semisolid consistency to a solid consistency. While present in the solidification zone the material undergoes substantial orientation while present as a semi-solid as discussed hereafter. The solidification zone could also be termed a "quench zone". The gaseous atmosphere present within the solidification zone preferably circulates so as to bring about more efficient heat transfer. In a preferred embodiment of the process the gaseous atmosphere of the solidification zone is provided at a temperature of about 10° to 40° C., and most preferably at about room temperature (e.g., at about 25° C.). The chemical composition of the gaseous atmosphere is not critical to the operation of the process provided the gaseous atmosphere is not unduly reactive with the polyester filamentary material. In a particularly preferred embodiment of the process the gaseous atmosphere of the solidification zone is air. Other representative gaseous atmospheres which may be selected for utilization in the solidification zone include inert gases such as helium, argon, nitrogen, etc.

The gaseous atmosphere of the solidification zone preferably impinges upon the extruded polyester material so as to produce a uniform quench wherein no substantial radial non-homogeneity exists across the fiber diameter. The uniformity of the quench may be demonstrated through the ability of the resulting filamentary material to exhibit no substantial tendency to undergo self-crimping upon the application of heat. A flat yarn accordingly preferably is produced.

The solidification zone is preferably disposed immediately below the spinneret and the extruded polyester material is present while axially suspended therein for a residence time of about 0.0008 to 0.4 second, and most preferably for a residence time of about 0.033 to 0.14 second. Commonly the solidification zone possesses a length of about 0.25 to 20 feet, and preferably a length of 1 to 7 feet. The gaseous atmosphere is also preferably introduced at the lower end of the solidification zone and withdrawn along the side thereof with the moving continuous length of polyester material passing downwardly therethrough from the spinneret. A center flow quench or any other technique capable of bringing about the desired quenching alternatively may be utilized. If desired, a hot shroud may be positioned intermediate the spinneret and the solidification zone.

The resulting filamentary material is next passed in the direction of its length through a conditioning zone provided with a gaseous atmosphere at a temperature above the glass transition temperature thereof and below the melting temperature thereof, i.e., commonly at about 90° to 180° C. (e.g., 90° to 140° C.) for a residence time of about 0.001 to 0.8 second wherein substantial crystallization of the previously solidified filamentary material takes place. The conditioning zone preferably is provided with a gaseous atmosphere at a temperature of about 110° to 120° C. and the moving filamentary material axially suspended therein. The preferred residence time for the filamentary material within the conditioning zone is about 0.0016 to 0.6 second, and most preferably about 0.03 to 0.09 second. If residence times much below about 0.001 second are employed, then a stable achievement of the desired property levels does not result. Longer residence times may be utilized will no commensurate advantage.

The chemical composition of the gaseous atmosphere provided within the conditioning zone is not critical to the operation of the process provided the gaseous atmosphere is not unduly reactive with the polyester filamentary material. Static air or steam conveniently may be selected. Other representative gaseous atmospheres which may be employed in the conditioning zone include inert gases such as helium, argon, nitrogen, etc. Band heaters or any other heating means may be provided so as to maintain the conditioning zone at the required temperature. The conditioning zone commonly has a length of about 0.5 to 30 feet, and preferably a length of about 5 to 12 feet.

The resulting filamentary material is withdrawn from the conditioning zone at a rate of about 1000 to 6000 meters per minute (preferably 2500 to 3500 meters per minute) while under a stress of about 0.15 to 0.6 gram per denier (preferably 0.2 to 0.4 gram per denier). Following extrusion the filamentary material is maintained under constant tension and throughout the process no stress isolation is utilized along the length of the filamentary material intermediate the spinneret and the point of withdrawal from the conditioning zone (i.e., the yarn is axially suspended in the absence of external contact in the region intermediate the spinneret and the point of withdrawal from the conditioning zone). When withdrawn from the conditioning zone the filamentary material commonly exhibits a denier per filament of about 1 to 10, e.g., about 1.5 to 5.

The improved polyester formation process may be conveniently carried out in conventional nylon equipment provided with a heated conditioning chamber of adequate length below the quench zone and having the required high stress take-up equipment. The results achieved with the polyesters described herein are considered to be unexpected to those skilled in polyester fiber technology.

The passage of the filamentary material through the conditioning zone in the precise manner as described surprisingly has been found to beneficially enhance the same through the modification of its internal structural morphology. More specifically, the tensile properties of the filamentary material are surprisingly improved thereby rendering a conventional hot drawing step unnecessary. The tensile strength and modulus of the filamentary material are improved and its shrinkage characteristics are diminished.

While present in the conditioning zone, the filamentary material is heat-treated under constant tension. During this heat treatment, small amounts of thermally induced elongation may occur, but this process is differentiated from a draw process because of the constant tension rather than the constant strain criteria. The level of tension on the filamentary material in the conditioning zone is extremely critical to the development of the desired structure and properties and primarily is influenced by the rate of withdrawal from the conditioning zone rather than friction with the surrounding gas. No stress isolation results along the filamentary material intermediate the spinneret and the point of withdrawal from the conditioning zone (i.e., the filamentary material is axially suspended in the absence of external stress isolating devices in the region intermediate the spinneret and the point of withdrawal from the conditioning zone). Should one omit the passage of the filamentary material through the conditioning zone, the denier and cross-sectional dimension of the filamentary material commonly are found to be identical.

In the high stress melt spinning operation as described the extruded filamentary material intermediate the point of its maximum die swell area and its point of withdrawal from the conditioning zone commonly exhibits a drawdown ratio of about 100:1 to 2000:1, and most commonly a drawdown ratio of about 600:1 to 1700:1. The "drawdown ratio" as used above is defined as the ratio of the maximum die swell cross-sectional area to the cross-sectional area of the filamentary material as it leaves the conditioning zone. Such substantial change in cross-sectional area occurs almost exclusively in the solidification zone prior to complete quenching. In some embodiments of the process, however, up to about a 4:1 reduction in cross sectional area of the filamentary material is observed in the conditioning zone via heat induced elongation as discussed above.

The theory whereby the present process is capable of producing polyester filamentary material exhibiting the properties recited is considered complex and incapable of simple explanation. It is believed, however, that the stress exerted upon the semi-solid filamentary material in the solidification zone produces an oriented crystalline fibrillar microstructure of polyester molecules within each fiber which serves to nucleate the epitaxial growth of polymer crystals intermediate adjoining fibrils. As the resulting filamentary material next passes through the conditioning zone, as defined, substantial epitaxial crystallization spontaneously occurs onto the oriented fibrillar structure. Such rapid crystallization forms a lamella overgrowth on the existing fibrillar structure with lamellar crystals extending between fibrils and with the lamellar crystals being joined by tie molecules.

The resulting filamentary material is amenable to further processing through the use of additional processing equipment or it may be used directly in applications requiring a continuous filament textile yarn. If desired the filamentary material subsequently may be converted from a flat yarn to a textured yarn, e.g., through the utilization of known false twist texturing conditions. Illustrative conditions for a yarn of 150 denier employ a yarn speed of 125 meters per minute, a feed roll heater plate temperature of 215° C., an over feed into the heater of about 3.5 percent, and a turn per inch of about 60.

The following examples are given as specific illustrations of the invention. It should be understood, however, that the invention is not limited to the specific details set forth in the examples. Reference is made in the examples to the apparatus arrangement illustrated in the drawing. The claimed invention is not restricted to the utilization of the apparatus illustrated in the drawing. In each example the polyester was polyethylene terephthalate having an intrinsic viscosity (I.V.) of 0.67. The intrinsic viscosity was determined from a solution of 0.1 gram of polymer in 100 ml. of ortho-chlorophenol at 25° C. The characterization of the polyester filament formed in each example is presented in Table I, Table II and Table III which follow all of the examples.

EXAMPLE 1

The polyethylene terephthalate polymer while in particulate form was placed in hopper 1 and was advanced toward spinneret 2 by the aid of screw conveyer 4. Heater 6 caused the polyethylene terephthalate particles to melt to form a homogeneous phase which was further advanced toward spinneret 2 by the aid of pump 8.

The spinneret 2 had a standard conical entrance and possessed a ring of 20 extrusion holes, each having a diameter of 20 mils. The molten polyethylene terephthalate was at a temperature of about 300° C. when extruded through spinneret 2.

The resulting extruded polyethylene terephthalate 10 passes directly from the spinneret 2 through solidification zone 12. The solidification zone 12 had a length of 6 feet and was vertically disposed. Air at room temperature (i.e., about 25° C.) was continuously introduced into solidification zone 12 at 14 which was supplied via conduit 16 and fan 18. The air was continuously withdrawn through elongated conduit 20 vertically disposed in communication with the wall of solidification zone 12, and was continuously withdrawn through conduit 22. While passing through the solidification zone the extruded polyethylene terephthalate was transformed into a continuous length of as-spun polyethylene terephthalate yarn. The polymeric material was first transformed from a molten to a semi-solid consistency, and then from a semi-solid consistency to a solid consistency while passing through solidification zone 12. The extruded polyethylene terephthalate was present in the solidification zone 12 for a residence time of about 0.045 second.

Upon being withdrawn from solidification zone 12 the continuous length of polyethylene terephthalate yarn 24 next immediately was passed through vertically disposed conditioning zone 26 having a length of 12 feet. A static air atmosphere was maintained in conditioning zone 26 at a temperature of 120° C. by the air of band heater 28 which surrounded the walls of the same. The polyethylene terephthalate yarn was present in the conditioning zone 26 for a residence time of about 0.09 second where it was structurally modified.

The resulting polyethylene terephthalate yarn was under a constant tension following extrusion and was withdrawn from conditioning zone 26 at a rate of 2500 meters per minute while under a stress of about 0.2 gram per denier. The extruded filamentary material intermediate the point of its maximum die swell area and its point of withdrawal from the conditioning zone was drawn down at a ratio of about 1400:1. The resulting polyethylene terephthalate yarn exhibited a denier per filament of 2, and was packaged at 30 after passing around godets 32 and 34, and contacting roller 36 which applied an anti-static lubricant.

The polyethylene terephthalate yarn was axially suspended in the absence of external contact intermediate the spinneret and the point of its withdrawal from conditioning zone 26. There was accordingly no stress isolation along the length of the same in this region and the fibrous material was under substantial stress throughout its processing which was exerted by rotation of packaging equipment 30.

COMPARATIVE EXAMPLE 2

For comparative purposes, Example 1 was repeated with the exception that the static air atmosphere of conditioning zone 26 was provided at room temperature (i.e., about 25° C.) instead of 120° C. The extruded filamentary material intermediate the point of its maximum die swell area and its point of withdrawal from the conditioning zone was drawn down at a ratio of about 1400:1.

EXAMPLE 3

Example 1 was repeated with the exception that the resulting polyethylene terephthalate yarn was withdrawn from conditioning zone 26 at a rate of 3000 meters per minute while under a stress of about 0.25 gram per denier. The extruded polyethylene terephthalate yarn was present in the solidification zone 12 for a residence time of about 0.036 second. The polyethylene terephthalate yarn was present in the conditioning zone 26 for a residence time of about 0.07 second. The extruded filamentary material intermediate the point of its maximum die swell area and its point of withdrawal from the conditioning zone was drawn down at a ratio of about 1500:1.

COMPARATIVE EXAMPLE 4

For comparative purposes, Example 3 was repeated with the exception that the static air atmosphere of the conditioning zone 26 was provided at room temperature (i.e., about 25° C.) instead of 120° C. The extruded filamentary material intermediate the point of its maximum die swell area and its point of withdrawal from the conditioning zone was drawn down at a ratio of about 1500:1.

COMPARATIVE EXAMPLE 5

For comparative purposes, Example 1 was repeated with the exception that: The spinneret was provided with a ring of 36 extrusion holes each having a diameter of 20 mils, the conditioning zone was provided at room temperature (i.e., at about 25° C.), and the yarn was withdrawn from the conditioning zone at a rate of 650 meters per minute while under a stress of about 0.018 grams per denier.

COMPARATIVE EXAMPLE 6

For comparative purposes, Example 1 was repeated with the exception that: The spinneret was provided with a ring of 36 extrusion holes each having a diameter of 20 mils, the conditioning zone was provided at room temperature (i.e., at about 25° C.), and the yarn was withdrawn from the conditioning zone at a rate of 1100 meters per minute while under a stress of 0.038 grams per denier.

COMPARATIVE EXAMPLE 7

For comparative purposes, Example 1 was repeated with the exception that: The spinneret was provided with a ring of 36 extrusion holes each having a diameter of 20 mils, the conditioning zone was provided at room temperature (i.e., at about 25° C.), and the yarn was withdrawn from the conditioning zone at a rate of 4000 meters per minute while under a stress of about 0.15 grams per denier.

COMPARATIVE EXAMPLE 8

For comparative purposes, Example 1 was repeated with the exception that the spinneret was provided with a ring of 36 extrusion holes each having a diameter of 20 mils and the as-spun yarn was collected on a bobbin after being withdrawn from the solidification zone at a rate of 2500 meters per minute while under a stress of about 0.2 grams per denier without passage through the conditioning zone. The yarn was unwound from the bobbin and passed through the conditioning zone maintained at 125° C. while under a stress of about 0.2 grams per denier and taken up at a rate of 200 meters per minute. The yarn was present in the conditioning zone for a residence time of about 1 second. No drawing took place while the yarn was present in the conditioning zone.

COMPARATIVE EXAMPLE 9

For comparative purposes, Example 3 was repeated with the exception that the as-spun yarn was collected on a bobbin after being withdrawn from the solidification zone at a rate of 3000 meters per minute while under a stress of about 0.25 grams per denier without passage through the conditioning zone. The yarn was unwound from the bobbin and passed through the conditioning zone maintained at 120° C. while under a stress of about 0.25 grams per denier and taken up at a rate of 200 meters per minute. The yarn was present in the conditioning zone for a residence time of about 1 second. Th as-spun yarn was drawn at a draw ratio of about 2.6:1 while present in the conditioning zone.

COMPARATIVE EXAMPLE 10

Comparative Example 5 was repeated with the exception that the as-spun yarn was drawn 3.3 times its length by continuous passage over a 12 inch hot shoe maintained at 80° C. while present in an air atmosphere. The as-spun yarn was supplied to the hot shoe at a rate of 50 meters per minute, and was in contact with the surface of the hot shoe for about 0.1 second.

COMPARATIVE EXAMPLE 11

Comparative Example 6 was repeated with the exception that the as-spun yarn was drawn 2.27 times its length by continuous passage over a 12 inch hot shoe maintained at 100° C. while present in an air atmosphere. The as-spun yarn was supplied to the hot shoe at a rate of 50 meters per minute, and was in contact with the surface of the hot shoe for about 0.1 second.

COMPARATIVE EXAMPLE 12

For comparative purposes, Example 1 was repeated with the exception that the spinneret was provided with a ring of 36 extrusion holes, each having a diameter of 20 mils and the as-spun yarn was collected on a bobbin after being withdrawn from the solidification zone at a rate of 1000 meters per minute while under a stress of about 0.008 gram per denier without passage through the conditioning zone. The yarn was unwound from the bobbin and was hot drawn 5 times its length by continuous passage over a 12 inch hot shoe maintained at 90° C. while present in an air atmosphere. The yarn was supplied to the hot shoe at a rate of 50 meters per minute, and was in contact with the surface of the hot shoe for 0.1 second.

COMPARATIVE EXAMPLE 13

Comparative Example 12 was repeated with the yarn product of that example being relaxed 20 percent by continuous passage over a hot roll maintained at 120° C.

The characterization of the polyester filament formed in Examples 1 through 13 is presented in Table I, Table II, and Table III which follow.

TABLE I

| Example No. | Claimed Invention | Denier Per Filament | Mean Yarn Tenacity (grams/denier) | Mean Yarn Initial Modulus (grams/denier) | Mean Yarn Elongation (percent) | Modulus Ratio |
|---|---|---|---|---|---|---|
| 1 | yes | 2 | 3.7 | 70 | 56 | 0.143 |
| 2 | no | 2 | 1.92 | 22.5 | 175 | 0.0036 |
| 3 | yes | 2 | 4.0 | 76 | 50 | 0.142 |

TABLE I-continued

| Example No. | Claimed Invention | Denier Per Filament | Mean Yarn Tenacity (grams/denier) | Mean Yarn Initial Modulus (grams/denier) | Mean Yarn Elongation (percent) | Modulus Ratio |
|---|---|---|---|---|---|---|
| 4 | no | 2 | 2.36 | 24.1 | 133 | 0.00417 |
| 5 | no | 15 | 1.2 | 19 | 416 | 0.00116 |
| 6 | no | 16 | 1.4 | 21 | 228 | 0.00176 |
| 7 | no | 6 | 2.7 | 32 | 95 | 0.00884 |
| 8 | no | 9 | 1.8 | 23 | 202 | 0.00200 |
| 9 | no | 4 | 3.8 | 74 | 47 | 0.0439 |
| 10 | no | 4 | 3.9 | 106 | 37 | 0.0310 |
| 11 | no | 7 | 3.7 | 83 | 33 | 0.0615 |
| 12 | no | 4 | 4.6 | 124 | 31 | 0.0455 |
| 13 | no | 5.3 | 4.0 | 50 | 59 | 0 |

TABLE II

| Example No. | Claimed Invention | Mean Yarn Shrinkage at 100° C. (percent) | Mean Yarn Shrinkage at 175° C. (percent) | Mean Yarn Internal Tension at 100° C. (grams/denier) | Mean Yarn Internal Tension at 175° C. (grams/denier) | Maximum Yarn Internal Tension (grams/denier) | Shrinkage Modulus at 100° C. (grams/denier) | Shrinkage Modulus at 175° C. (grams/denier) |
|---|---|---|---|---|---|---|---|---|
| 1 | yes | 3.6 | 6.6 | 0.36 | 0.25 | 0.37 | 10.0 | 3.79 |
| 2 | no | 33.0 | 16.5 | 0.026 | 0.005 | 0.039 | 0.079 | 0.030 |
| 3 | yes | 3.8 | 7.8 | 0.41 | 0.35 | 0.42 | 10.8 | 4.49 |
| 4 | no | 33.0 | 22.0 | 0.033 | 0.011 | 0.052 | 0.10 | 0.050 |
| 5 | no | 18.5 | 10.0 | 0.004 | 0.001 | 0.007 | 0.022 | 0.010 |
| 6 | no | 35.5 | 25.5 | 0.013 | 0.003 | 0.019 | 0.037 | 0.012 |
| 7 | no | 18.0 | 8.0 | 0.051 | 0.017 | 0.065 | 0.283 | 0.212 |
| 8 | no | 39.5 | 33.0 | 0.018 | 0.005 | 0.034 | 0.046 | 0.015 |
| 9 | no | 6.0 | 9.0 | 0.195 | 0.21 | 0.215 | 3.25 | 2.33 |
| 10 | no | 6.5 | 13.5 | 0.30 | 0.30 | 0.32 | 4.62 | 2.30 |
| 11 | no | 4.5 | 8.5 | 0.23 | 0.275 | 0.28 | 5.11 | 3.24 |
| 12 | no | 5.3 | 14.2 | 0.28 | 0.32 | 0.33 | 5.28 | 2.25 |
| 13 | no | 0 | 0.9 | less than 0.001 | less than 0.001 | 0.04 | 0 | 0 |

TABLE III

| Example No. | Claimed Invention | Mean Single Filament Birefringence | Mean Single Filament Crystalline Orientation Function | Mean Single Filament Amorphous Orientation Function |
|---|---|---|---|---|
| 1 | yes | 0.1188 | 0.92 | 0.30 |
| 2 | no | 0.0253 | * | 0.10 |
| 3 | yes | 0.1240 | 0.94 | 0.28 |
| 4 | no | 0.0406 | * | 0.17 |
| 5 | no | 0.0052 | * | 0.02 |
| 6 | no | 0.0135 | * | 0.05 |
| 7 | no | 0.0557 | 0.76 | 0.11 |
| 8 | no | 0.0231 | * | 0.09 |
| 9 | no | 0.1468 | 0.84 | 0.54 |
| 10 | no | 0.1782 | 0.86 | 0.45 |
| 11 | no | 0.1448 | 0.89 | 0.44 |
| 12 | no | 0.1991 | 0.87 | 0.74 |
| 13 | no | 0.1863 | 0.87 | 0.67 |

* Not crystalline enough to yield useful diffraction

Only Example Nos. 1 and 3 produced a polyester filament in accordance with the present invention. In Comparative Examples 8 and 9 it is demonstrated that the desired filament cannot be produced if one should attempt to divide the presently claimed process by collection of the filamentary material after it leaves the solidification zone, and by subsequent passage of the same while under a comparable stress through the conditioning zone provided at a comparable temperature. Additionally, Comparative Examples 2, 4, 5 to 7, and 10 to 13 demonstrate that the desired filament is not produced under a variety of differing processing conditions.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. An improved polyester filament exhibiting no substantial tendency to undergo self-crimping upon the application of heat comprising at least 85 mol percent of polyethylene terephthalate suitable for use in commercial applications having an interconnected highly oriented crystalline microstructure co-extensive with the length of the said filament coexisting with an interdispersed substantially disoriented non-crystalline phase, said filament exhibiting a propensity to undergo a low degree of shrinkage with a high degree of force at an elevated temperature as evidenced by a modulus ratio of at least 0.1.

2. An improved polyester filament according to claim 1 comprising at least 90 mol percent polyethylene terephthalate.

3. An improved polyester filament according to claim 1 wherein said filament is substantially all polyethylene terephthalate.

4. An improved polyester multifilament yarn comprising 6 to 200 filaments according to claim 1.

5. An improved polyester filament according to claim 1 which exhibits at 25° C. a mean tenacity of at least 3.25 grams per denier, a mean initial modulus of at least 55 grams per denier, and a mean elongation of less than 75 percent.

6. An improved polyester filament according to claim 1 which exhibits at 25° C. a mean tenacity of at least 3.75 grams per denier, a mean initial modulus of at least 75 grams per denier, and a mean elongation of 50 percent or less.

7. An improved polyester filament according to claim 1 wherein said filament exhibits a mean birefringence within the range of about 0.10 to 0.14.

8. An improved polyester filament according to claim 1 which at 100° C. exhibits a mean longitudinal shrinkage of less than 5 percent, and at 175° C. exhibits a mean longitudinal shrinkage of less than 8 percent.

9. An improved polyester filament according to claim 1 which at 100° C. exhibits a mean longitudinal shrinkage of less than 3.8 percent, and at 175° C. exhibits a mean longitudinal shrinkage of less than 7.6 percent.

10. An improved polyester filament according to claim 1 wherein said filament exhibits a modulus ratio of about 0.1 to 0.2.

11. An improved polyester filament according to claim 1 wherein said filament has a denier of about 1 to 15.

12. An improved multifilament yarn composed of polyethylene terephthalate filaments of about 1 to 15 denier per filament exhibiting no substantial tendency to undergo self-crimping upon the application of heat suitable for use in commerical applications and having an interconnected highly oriented crystalline microstructure coextensive with the length of said filaments coexisting with an interdispersed substantially disoriented non-crystalline phase, said filaments exhibiting a propensity to undergo a low degree of shrinkage with a high degree of force at an elevated temperature as evidenced by a modulus ratio of about 0.1 to 0.2, and wherein said yarn exhibits at 25° C. a mean tenacity of at less 3.75 grams per denier, a mean initial modulus of at least 75 grams per denier, a mean elongation of 50 percent or less, a mean longitudinal shrinkage at 100° C. of less than 3.8 percent, and a mean longitudinal shrinkage at 175° C. of less than 7.6 percent.

13. An improved polyethylene terephthalate multifilament yarn according to claim 12 which is composed of about 6 to 200 filaments.

14. An improved multifilament yarn composed of polyester filaments exhibiting no substantial tendency to undergo self-crimping upon the application of heat and comprising at least 85 mol percent of polyethylene terephthalate suitable for use in commerical applications having an interconnected high oriented crystalline microstructure coextensive with the length of said filaments coexisting with an interdispersed substantially disoriented noncrystalline phase, said yarn exhibiting a mean initial modulus at 25° C. of at least 55 grams per denier, and said filaments exhibiting a birefringence of about 0.10 to 0.14, crystalline orientation function of at least 0.88, and an amorphous orientation function of not more than 0.35.

15. An improved polyester multifilament yarn according to claim 14 wherein said filaments comprise at least 90 mol percent polyethylene terephthalate.

16. An improved polyester multifilament yarn according to claim 14 comprising about 6 to 200 of said filaments.

17. An improved polyester multifilament yarn according to claim 14 which exhibits at 25° C. a mean tenacity of at least 3.25 grams per denier, and a mean elongation of less than 75 percent.

18. An improved polyester multifilament yarn according to claim 14 which exhibits at 25° C. a mean tenacity of at least 3.75 grams per denier, a mean initial modulus of at least 75 grams per denier, and a mean elongation of 50 percent or less.

19. An improved polyester multifilament yarn according to claim 14 wherein said yarn at 100° C. exhibits a mean longitudinal shrinkage of less than 5 percent, and at 175° C. exhibits a mean longitudinal shrinkage of less than 8 percent.

20. An improved polyester multifilament yarn according to claim 14 wherein said yarn at 100° C. exhibits a mean longitudinal shrinkage of less than 3.8 percent, and at 175° C. exhibits a mean longitudinal shrinkage of less than 7.6 percent.

21. An improved polyester multifilament yarn according to claim 14 wherein said filaments exhibit a propensity to undergo a low degree of shrinkage with a high degree of force at an elevated temperature as evidenced by a modulus ratio of at least 0.1.

22. An improved polyester multifilament yarn according to claim 14 wherein said filaments have a denier per filament of about 1 to 15.

23. An improved multifilament yarn of polyethylene terephthalate filaments of about 1 to 15 denier per filament exhibiting no substantial tendency to undergo self-crimping upon the application of heat suitable for use in commercial applications and having an interconnected highly oriented crystalline microstructure coextensive with the length of said filaments coexisting with an interdispersed substantially disoriented non-crystalline phase, said yarn exhibiting a mean initial modulus at 25° C. of at least 55 grams per denier, and said filaments exhibiting a birefringence of about 0.11 to 0.14, a crystalline orientation function of at least 0.88, and an amorphous orientation function of not more than 0.35.

24. An improved polyethylene terephthalate multifilament yarn according to claim 23 composed of about 6 to 200 of said filaments.

25. An improved polyethylene terephthalate multifilament yarn according to claim 23 wherein said filaments exhibit a propensity to undergo a low degree of shrinkage with a high degree of force at an elevated temperature as evidenced by a modulus ratio of about 0.1 to 0.2.

* * * * *